US005547298A

United States Patent [19]

Wouters et al.

[11] Patent Number: 5,547,298

[45] Date of Patent: Aug. 20, 1996

[54] DYE RIBBON PACKAGE FOR THERMAL PRINTERS

[75] Inventors: Paul Wouters, Vrouw Waver; Lieven Dirx, Oud-Turnhout, both of Belgium

[73] Assignee: Agfa-Gevaert N. V., Mortsel, Belgium

[21] Appl. No.: 496,110

[22] Filed: Jun. 28, 1995

[51] Int. Cl.[6] ..... B41J 29/02; B65H 75/00

[52] U.S. Cl. ..... 400/692; 400/207; 400/242; 400/246; 400/693.1; 206/393

[58] Field of Search ..... 400/207, 208, 400/242, 243, 244, 245, 246, 692, 693.1, 693; 206/391, 393, 394, 395, 396, 397, 407, 415; 229/123, 178

[56] References Cited

U.S. PATENT DOCUMENTS

| | | | |
|---|---|---|---|
| 3,332,546 | 7/1967 | George | 206/395 |
| 3,530,980 | 9/1968 | Link | 206/394 |
| 4,151,914 | 5/1979 | Blatt | 206/395 |
| 5,174,667 | 12/1992 | Sugimoto et al. | 400/207 |
| 5,352,049 | 10/1994 | Shiraishi et al. | 400/246 |
| 5,399,035 | 3/1995 | Nakae | 400/207 |
| 5,415,486 | 5/1995 | Wouters et al. | 400/692 |
| 5,451,996 | 9/1995 | Awai et al. | 400/208 |

FOREIGN PATENT DOCUMENTS

| | | | |
|---|---|---|---|
| 0283971 | 11/1988 | Japan | 400/246 |
| 4-144782 | 5/1992 | Japan | 400/246 |
| 4-259583 | 9/1992 | Japan | 400/246 |

*Primary Examiner*—Ren Yan
*Attorney, Agent, or Firm*—William J. Daniel

[57] ABSTRACT

An improved package for supply and take-up spools of dye ribbon for use with the cassette of a thermal printer in which the ribbon spools include a part, e.g. a flange, shaped for engagement with a correspondingly shaped socket in the carton holding the spools during transport etc. to thereby prevent relative rotation of the spools while within the carton. An improved method for transferring the dye ribbon spools to the thermal printer cassette from any package in which the take-up and supply spools are supported in generally parallel relation is also described in which by virtue of a special orientation of the spools in the package combined with a peculiar sequence of transfer steps, a sufficient length of dye ribbon is unwrapped from the two spools during their transfer to the cassette spools but without causing either spool to undergo independent rotation about its axis as to bridge a gap between the spool package and printer cassette when in spool transfer relation as well as to accommodate a greater separation between the spools when loaded within cassette than when held within the package.

18 Claims, 5 Drawing Sheets

DYE RIBBON PACKAGE FOR THERMAL PRINTERS

BACKGROUND OF THE INVENTION

Field of the Invention

This invention relates to a package for a dye ribbon supply-take-up roll combination used in a thermal printer or the like and comprising a supply spool carrying a supply roll of dye ribbon wound thereon and a take-up spool having a leading end of the dye ribbon affixed thereto together with an improved method for transferring the dual spool combination from the package to a removable cassette adapted to be positioned at the printing station of the thermal printer.

Cross-Reference to Related Application

The present inventions are improvements upon a broadly similar dye ribbon package and a method for loading the removably cassette of the thermal printer disclosed and claimed in prior copending application Ser. No. 08/136,267, filed Oct. 15, 1993, commonly assigned with this application.

Description of the Prior Art

As is explained in prior copending application Ser. No. 08/136,267, the contents of which are incorporated by reference herein in their entirety, in a typical thermal printer, a dye ribbon in the form of a web-type dye carrier containing a series of spaced frames of differently colored heat-transferable dyes is wound of a supply spool. The ribbon is unwound from the supply spool and rewound on a take-up spool. The ribbon advances through a nip formed between a thermal print head and a dye-absorbing receiver sheet. The receiver sheet may, for example, be coated on synthetic paper and the print head is formed of a plurality of heating elements. When heat is supplied to the dye ribbon, dye is transferred to the receiver sheet.

At the beginning of a print cycle, the receiver sheet must be clamped to the drum of the printer which is then in a home position. After being clamped to the drum, the drum is rotated to advance the receiver sheet beneath the print head. The heating elements of the print head are energized in a controlled pattern to form the desired dye image. The drum makes several revolutions as differently colored dye images are transferred one by one to the receiver sheet. In this way, a final multi-colored image is produced upon the receiver sheet, after which the clamp of the drum is opened and the sheet ejected from the thermal printer. The drum then advances to return the clamping mechanism to home position and the sequence of steps is ready to be repeated.

The dye ribbon is difficult to handle since it typically consists of a thin layer of a heat-transferable dye carried on an extremely thin plastic film as a base and which may be only a few, say 10 or so, micrometers in thickness, in order to minimize resistance to heat transfer from the print head heating elements toward the receiver sheet. For that reason, the supply spool and take-up spool are usually carried rotatably in a cassette which is ordinarily in the form of a frame supporting the dye ribbon spools in spaced parallel relation in journals provided for that purpose, with a length of ribbon extending therebetween in unsupported fashion and hence accessible to a thermal printing head disposed on one side of the cassette frame.

The ribbon is actually in the form of a lengthy web or film having a transverse dimension of several inches corresponding to the width of a sheet of reception material to be printed, e.g. 8½ inches for a standard letter size sheet and it will be understood that where the term "ribbon" is used herein, it is intended to encompass film having a considerable transverse dimension as well as the narrower strip material more commonly associated with the name "ribbon".

The reception sheet can for example be coated synthetic paper and can be mounted, e.g. by clamping devices, on the peripheral surface, or portion thereof, of a rotatably driven printing drum. For printing, the drum with the reception sheet clamped thereon usually makes a plurality of revolutions, one for each of the colors to be printed, and the differently colored partial images are created by dye transferred to the sheet in carefully controlled registration by heating the ribbon by means of the heating elements of the printer, At the completion of the cycle, the reception sheet now printed with the full-colored image is removed from the drum by releasing the clamping devices and ejected from the printer, after which a fresh reception is placed on the drum and the cycle repeated for the next image.

Because it is extremely thins and consequentially flimsy in nature, the dye ribbon, notwithstanding a substantial tensile strength, is quite delicate and, more importantly, difficult to handle. The difficulty is considerably aggravated by the need to manipulate the supply and take-up spools simultaneously with the web of ribbon stretching therebetween. If the manipulation is done carelessly or if an excessive length of the ribbon is unwound from the supply roll during manipulation, requiring that the excess length be rewound on the supply spool, the risk is high that wrinkles or creases in the ribbon will result and thus degrade the quality of the ultimate image.

In prior copending application Ser. No. 08/136,267, the dye ribbon package was made of cardboard or similar sheet stock bent up at the sides of a bottom or base wall to form upstanding side walls which were cut out with two sets, one for each spool, of upwardly opening generally U-shaped slots to rotatably receive opposite ends of the supply and take-up spools and support the same in spaced parallel relation with sufficient clearance from the base wall. A flap was also bent up from the sheet stock to form a rear end wall extending between the side walls along one side and an interconnected top cover that could be engaged at its free edge to the margin of the base opposite the end wall. The (virtually empty) take-up spool was situated in the set of slots nearer the end wall while the (full) supply roll was situated in the other set of slots while the connecting length of dye ribbon extended from beneath the bottom of the supply spool along an inclined path angled upwards and rearwardly toward the rear end wall and then over and around a top arc of the take-up spool to its anchoring locus thereon.

For loading of the printer cassette, the dye ribbon package was placed on a flat surface, the top cover opened and the cassette frame was arranged on the surface in reasonably close and parallel proximity to the front (open) end of the package. The spool remote from the cassette, i.e. the take-up spool, was carefully lifted from its set of slots and inserted at its ends in the set of journals of the cassette remote from the ribbon package and then the spool nearest to the cassette, i. e. the supply spool, was carefully lifted from its set of slots in the package and inserted into the set of journals of the cassette nearest to the ribbon package. Alternatively, the order of spool transfer could be reversed but in any case, the spool nearest the cassette was inserted in the cassette journals nearest the package and the spool remote from the cassette in to journals remote from the package.

Although this package structure and its related mode of spool transfer was superior to similar packages known for the same purpose in the prior art and was effective to maintain the spools and interconnecting length of dye ribbon under proper control, it was discovered that the practical execution of the concept of the prior application necessarily resulted in the creation of an excess length of dye ribbon bridging the inherent separation between the mutually adjacent package slots and cassette journals. Even if the package and cassette were placed in direct abutment, a separation between the axes of the nearest slots and journals nevertheless existed by virtue of the unavoidable spacing of the package slots from the package front edge and of the cassette journals from the cassette edges.

That is to say, even if the spacing between the two parallel journal axes in the cassette were selected to equal the spacing between the axes of the two sets of U-shaped slots in the package, when one spool was shifted from the package slots to its journal in the cassette, the distance from the axis of that spool in the cassette to the axis of the spool remaining in the package (irrespective of which of the supply and take-up rolls were shifted first) was greater than the distance between the spools when both were within either the package or the cassette. This is because when the first spool is shifted from package to cassette, the length of dye ribbon stretching from the shifted spool to the second spool in the package must bridge the gap between the axes of the nearest spool position in the juxtaposed package and cassette.

Two consequences arose from this result, both with at least possibly undesirable effects. First, the extra length of dye ribbon had to be generated by the rotation of the supply spool, either by in situ rotation while it was seated in its slots in the package or manually while it was being shifted to the cassette. In either case, an opportunity was presented for the side edges of the unwinding ribbon to be damaged by frictional engagement with end flange on the roll undergoing such rotation and extreme care was required to avoid such damage.

Second, the presence of a hanging or draping length of ribbon in the cassette when the latter was placed in operative position in the thermal printer was impermissible. Hence, it was necessary to take measures to remove this excess length of ribbon before placing the loaded cassette in to thermal printer by manually rotating one or the other of the spools in the cassette journals through a sufficient arc of rotation to rewind the loose length of ribbon thereon. This measure was inconvenient and carried some risk creasing or wrinkling the dye ribbon.

Moreover, for protection of the roll of dye ribbon wound on the spools, the spools were provided with circular flanges inboard of their projecting free ends for seating in the package slots and cassette journals. The flanges were advantageously situated as close as possible to the opposite ends of the ribbon roll because the presence of clearance between the roll ends and the flanges permitted axial sloughing or telescoping of some of the windings of the roll that interfered with the subsequent precision advancement of the ribbon during operation of the printer. However, the closer the flanges were located to the roll ends, the greater the danger of the ribbon edges rubbing against the flanges while unwinding during operation and becoming damaged.

SUMMARY OF THE INVENTION

In accordance with the invention, an improved method for transferring the dye ribbon spools from their package to the thermal printer cassette has been devised whereby by virtue of a rearrangement of the orientation of the spools in the package, it is unnecessary for either spool to undergo any unwinding during transfer to the first spool from package to cassette or to require any rewinding after the transfer of both spools to the cassette has been completed. This new transfer technique has made possible the development of a structurally modified dye ribbon package wherein the ribbon spools are positively held against rotation while contained within the package when the package is open for their removal as well as closed for transportation. And the new package structure can be achieved by the thermo-forming or heat molding of thin stiffly flexible (and inexpensive) plastic sheets that can be accomplished by a more efficient and less costly manufacturing operation than was possible with the original cardboard (and more expensive) package of the prior application.

In addition, because the spools are not required to be able to turn while being transferred to the printer cassette, the flanges of the spools can be mounted on the spool ends for limited axial sliding movement. Thus, when the spools are within the package, the flanges can be displaced to an axial position on the spools in intimate proximity to the ends of the ribbon roll and thereby confer maximum protection against axial telescoping of the roll winding during transportation and handling. Then, when the spools are removed from the package, the flanges can be displaced away from the roll ends, e.g. by a spring biasing force, to introduce clearance from the roll ends and thereby achieve maximum security against rubbing of the ribbon edges during unwinding.

BRIEF DESCRIPTION OF THE DRAWINGS

Two illustrative embodiments of the invention are shown by way of example and not for purposes of limitation in the accompanying drawings in which.

DETAILED DESCRIPTION OF THE INVENTION

The Method of the Invention

The improved method of the invention is predicated upon a special orientation of the supply and take-up dye ribbon spools both with respect to one another as well as with respect to the carton or container therefor. This orientation is revealed in FIG. 1 wherein an open package with the ribbon spools contained therein is shown in loading relationship to a typical frame-like cassette of a thermal printer.

Figure 1:
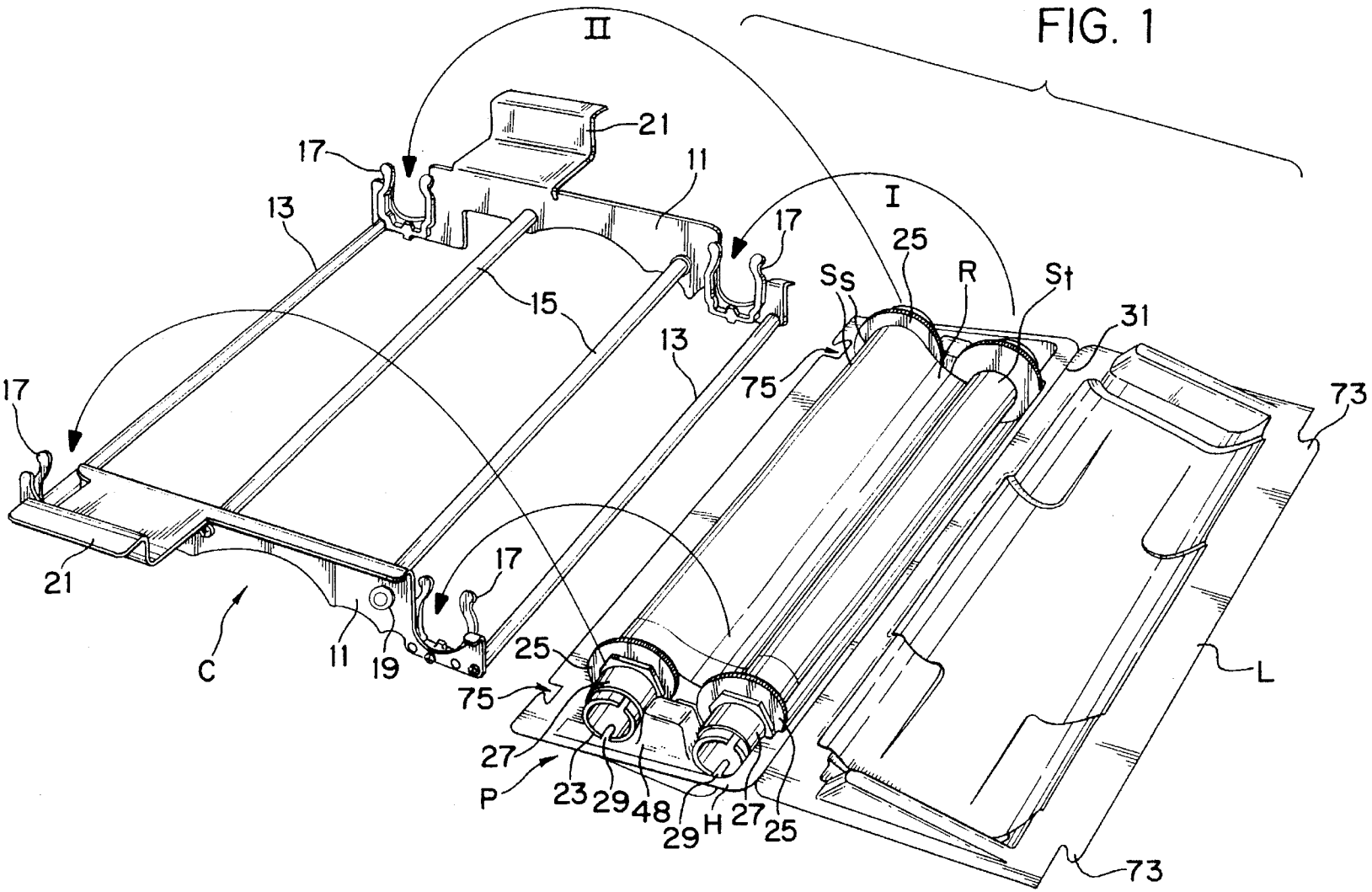
FIG. 1 is perspective view of a dye ribbon package according to the invention in open condition in loading relation to a frame-frame-like cassette of a thermal printer and showing the execution of the method of the invention.

The effective practice of the improved method does not depend upon the particular structural features of the carton or container aspect of the invention; in fact, the method could be readily carried out using the package shown in copending application Ser. No. 08/136,267, discussed above. However, the inventive carton does incorporate structural features designed to advantageously assist the fast and smooth execution of the method and for that reason, as well as convenience, the carton of the package included in FIG. 1 does correspond to that of the invention, FIG. 1 shows the package and thermal printer cassette in loading position. The cassette generally designated C is in the form of an open frame having side plates 11 held in spaced apart parallel relation by two pairs of rigid rods. The rods of a first pair 13 are fixedly attached at their ends to the side plates at the opposite end corners while the rods of a second pair 15 occupy a somewhat higher position above the plane of and between the corner pair and serve as guide rods for the dye ribbon. Affixed to side plates 11 directly adjacent the corner rods 13 are two pairs of generally U-shaped bearing clips 17, each pair being in opposed axially spaced and aligned relation for supporting each dye ribbon spool for rotation during operation of the thermal printer. The two pairs of bearing clips thus define the spool positions in the cassette C. In terms of construction, bearing clips 17 are of smooth hard plastic formed by injection molding or the like in a generally U-shape. The upstanding legs of bearing clips 17 are bowed toward one another so as to positively retain the spools therein but the legs are sufficiently flexible that they can yield by flexing apart to enable the spools to be inserted and removed.

Bearing in mind the fact that the diameter of both of the rolls of dye ribbon on the spools changes during operation, the supply roll growing smaller in diameter while the take-up roll grows larger, the second pair of rods 15 are positioned somewhat higher, i.e. above the plane of the corner rods 13. than are the center axes of the bearing clips so as to provide some measure of directional control over the path of the dye ribbon passing from one spool to the other. Although the guiding rods 15 could be symmetrically disposed between the corner rods 13, since the cassette must be correctly positioned in the thermal printer for feeding of the dye ribbon in the proper direction, one of the sets of bearing clips is designated to receive the take-up spool (and can be color-coded in relation to the take-up spool to indicate such designation). Preferably, the guiding rod for this set is, as can be plainly seen in the drawing, located nearer the end of the frame than the guiding rod for the other set which is to hold the supply roll and the closer rod preferably has its ends held in sleeve bearings 19 embedded in the side plates for free independent rotation thereof. Of course, the other guiding rod could also be mounted in bearings for rotation if desired.

Brackets 21 project laterally from side plates 11 adjacent the supply spool end of cassette C to facilitate mounting of the cassette in place in the thermal printer but need not further discussed since the operative position of the cassette has no bearing on the invention.

In FIG. 1, the cassette C has been placed on a suitable flat supporting surface and an elongated dye ribbon package is placed in reasonably close proximity thereto with its longitudinal edges substantially parallel to the spacing rods 13, 15 of the cassette. To avoid confusion and where the context calls for differentiation, the term "carton" will be employed herein to refer to the container alone, i. e. apart from the spools held therein, (and will be designated H) while the term "package" should be taken to mean the overall assembly of carton and spool contents (and will be designated P).

As shown, package P is open and contains a supply spool $S_s$ and a take-up spool $S_t$ in slightly spaced apart parallel relation and ready for transfer one by one from the package to the spool positions, as defined by bearing clips 17, in the cassette. The supply spool carries a roll of dye ribbon R. Although not shown in the drawings because it is conventional, ribbon R is made of a base of very thin plastic film, such a polyester, carrying a thin layer of a suitably colored thermally transferable, i. e. volatile, dye. A leading length (which can be free of dye for convenience in handling) of ribbon R extends from the supply roll to the take-up spool $S_t$ for attachment to the take-up spool and winding around the take-up roll for at least approximately one turn or winding of the ribbon for a reason that will be explained momentarily.

The orientation of supply spool $S_s$ and take-up spool $S_T$ in the package as well as the path of the interconnecting length of ribbon extending between them is critical to the concept of the present method. The take-up spool $S_t$ must be situated in the package in a position that is remote from the cassette when the package and cassette are in loading position as shown. Thus, where the package includes a cover or lid L, as shown, the take-up spool is located nearer the cover, to the rear of carton H, while the supply spool is located adjacent the free edge of the package, to the front of carton H. Assuming an observation vantage point from the left end of the package P viewed in FIG. 1, ribbon R is wound on the supply spool in a clockwise direction and its lending end extends from the uppermost or exposed side of the supply spool periphery in a downwardly inclined direction to the lowermost and concealed side of the take-up spool periphery to be wound on the latter in a counterclockwise direction for at least about one turn as stated. A clearer view of the orientation of the spools but with the carton itself omitted appears in FIG. 6.

The respective paths taken by the spools during their transfer are shown by the arrows is FIG. 1 which are designated I and II to indicate the order or sequence of the transfer steps. It will be understood that the curvature of arrows I and II is ideal; the actual movement of the spools is carried out manually and hence may deviate somewhat from the ideal path. According to the necessary sequence of steps, take-up spool $S_t$ is first removed by hand from carton H and moved along its path I to be introduced into the cassette at the set of bearing clips 17 which is nearest to the package. As can be visualized from FIG. 6, the arcuate movement of the take-up spool (given the critical orientation specified and assuming no relative rotation of the take-up spool or supply spool) from the side of supply spool $S_s$ remote from the cassette to the opposite side of the supply spool causes a portion of the ribbon winding on the take-up spool (equal to about one-half of the circumference of the winding) to be freed from the take-up roll. As a result, even though the take-up spool position in the cassette (in the set of bearing clips proximate to the package P) is separated from the location of the supply spool in the package a greater distance (due to a reasonable clearance gap between cassette and package) than the original separation between the take-up and supply spool position in the package, the extra length ribbon generated in this manner will be sufficient to bridge any reasonable gap.

Then, supply spool $S_s$ is taken from its position in the package and transferred by hand to the supply spool position in cassette C (at the set of cassette clips 17 that is remote from the package) along the path generally by arrow II. While perhaps less easy to visualize in FIG. 6, this movement of the supply spool (and again assuming no rotation about their axes of either supply or take-up spool) will release or free up an additional length of ribbon from the outer winding of the supply roll (also roughly equal to one-half of the circumference of the supply roll). As a consequence of the twofold release of ribbon from the windings of both spools as an inherent result of the specified geometry, the spools can be effectively transferred from package to cassette with no independent rotation of either spool about its own axis despite the fact that the distance separating the axes of the two spool positions in the cassette is twice or more the distance originally separating the axes of the spools in the package.

The Package of the Invention a. The Dye Ribbon Take-Up and Supply Spools

Figure 3:
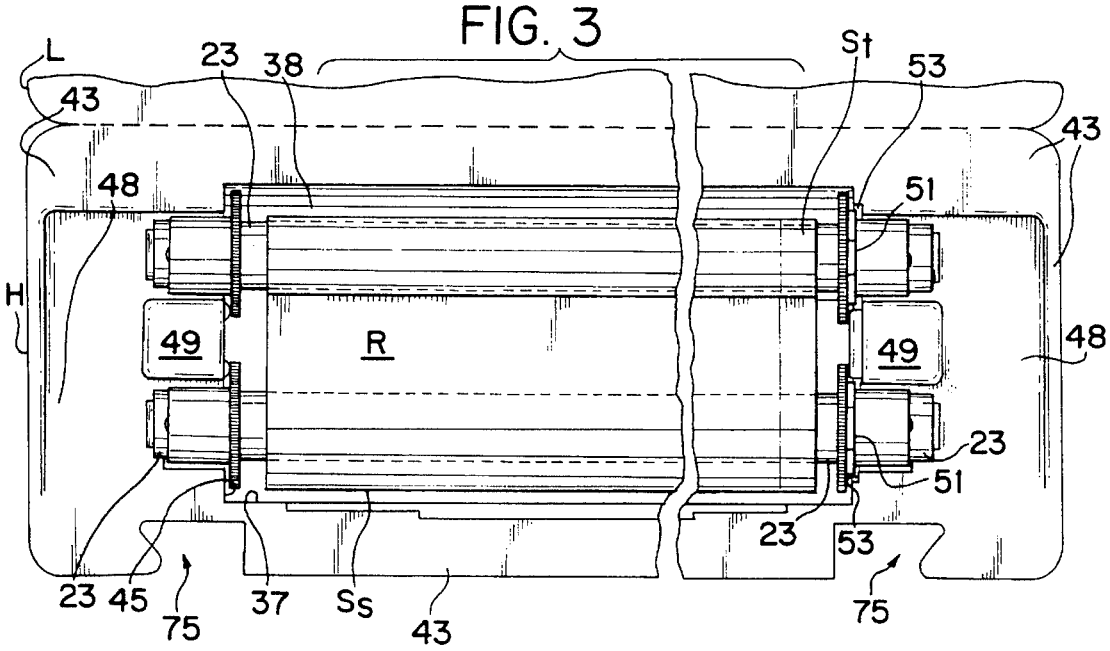
FIG. 3 is a top plan view, broken away to reduce the length wise dimension, of the open base of the package of the invention with the dye ribbon spools contained therein.
Figure 6:
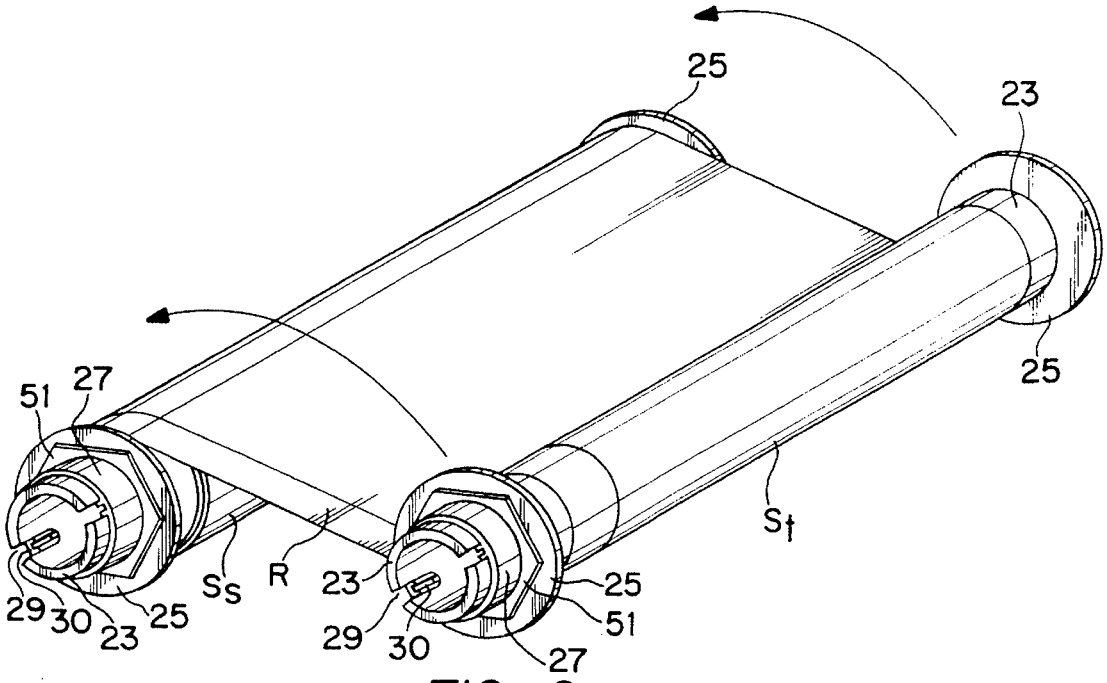
FIG. 6 is a perspective view showing the dye ribbon supply and take-up spools removed from the package with the spools in operative relationship utilized in the method of the invention.

Prior to taking up a description of the components of the package of the invention, the spools themselves will be explained. Referring to FIGS. 1, 3 and 6, the supply spools $S_s$ and take-up spools $S_t$ are constructed similarly. Each spool has an elongated cylindrical hollow core 23 somewhat greater in length than the width of the dye ribbon to be wound thereon which depends in turn on the format of the reception sheet used in the thermal printer, An exemplary ribbon width is approximately 10.5 in. for which a suitable core length is roughly 12.5 in. The diameter of core 23 can vary but a typical useful diameter is about 1 in.

Located a short distance inboard of each end of core 23, say about ¾ in. from the end, is a cylindrical flange 25 which has a diameter exceeding the diameter of the fully wound roll of ribbon on the supply spool and accordingly projects radially outwardly of the fully wound roll periphery to protect the same. The supply roll diameter, and thus that of flanges 25 will depend on the length of ribbon that is desired which can be varied; a typical roll diameter is about 1¼ in. and a flange diameter of about 1⅝ in. The periphery of each flange 25 can be knurled, as indicated in the specified figures, to enable the operator to grip more readily the flanges with the fingers and rotate the spools as may be necessary to tighten the ribbon between the spools as a final step in the loading procedure just prior to beginning the printing operation. The actual advance of the spools during printing is achieved with a driving spindle axially engaging an end of the cores.

One could form the flanges 25 integrally with the associated core but it is preferred to form the flanges 25 separately from the core and to provide each flange 25 with an integral hollow cylindrical collar 27 projecting axially of the flange and sized to fit in telescoping relation over the respective ends of a core. To prevent relative rotation between the collars (with their flanges) and the supporting core, the core ends are slotted axially at diametrical opposite points on their periphery, as at 29, for engagement by lugs 30 (see FIG. 6) projecting internally of the collars for that purpose.

Cores 23 also have small apertures (not seen in FIGS. 1, 3, and 6) at diametrically opposite peripheral points orthogonal to the slots 29 for engagement by internally projecting short nibs (not visible) on the inner side of collars 27 in order to anchor the flanged collars against relative axial movement on the core ends. To allow the collars with the internal nibs to be fitted on the core ends, end slots 29 have an axial depth extending beyond the transverse locus of the apertures which allows the core ends to be compressed slightly radially inwardly enough for the nibbed collars to slide over the core ends until the nibs enter the apertures. (The cooperation of the slots and lugs, on the one hand, and apertures and nibs, on the other hand will clearer from the subsequent description of an alternative embodiment of spool structure with reference to FIGS. 7 and 8.)

End portions of cores 21 can serve as journals for enabling the spools to be supported for rotation in the bearing clips 17 of the cassette during operation of the thermal printer. However, it is more advantageous for the outer peripheries of collars 27 to have this function in allowing for a cheaper construction for the cores while the flanged collars are molded with closer tolerances of a hard slick plastic material providing good anti-friction qualities.

Making the cores and flanged collars separately from one another has another useful consequence in that the collars at either or both ends of a core can be made of two contrasting colors, one designating the supply spool $S_s$ and another designating the take-up spool $S_t$, that are color-coded with the colors of the two sets of bearing clips 17 on the cassette. In this way, the relationship for purposes of transfer of the respective spools in the original package to the respective sets of clips in cassette C becomes self-evident.

b. The Carton and Cover of the Package

Figure 2:
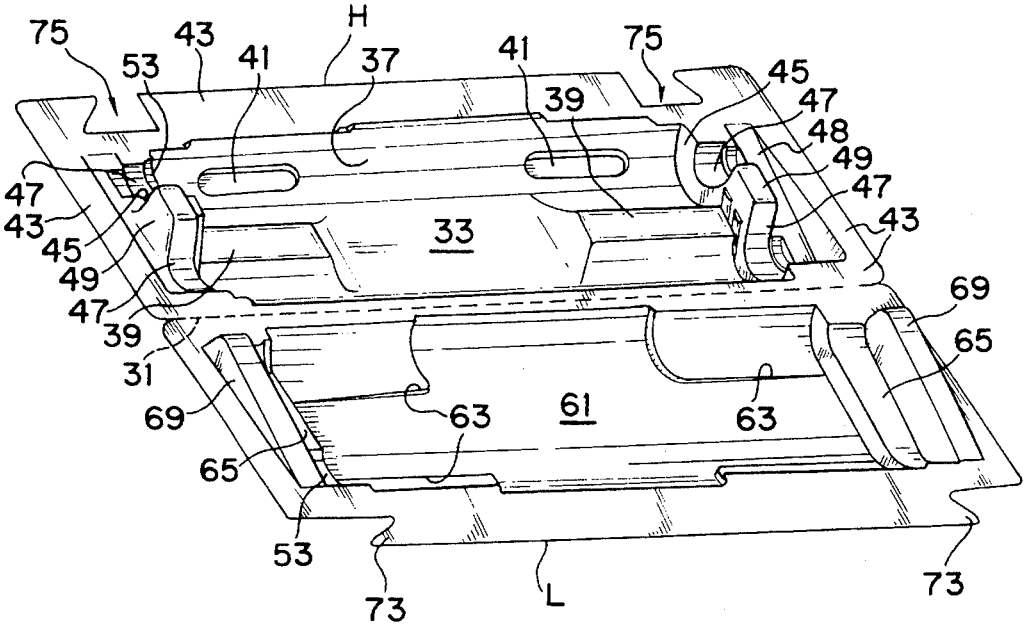
FIG. 2 is a perspective view of the dye ribbon carton exclusive of the spools of dye ribbon and in open condition.

Turning now to a description of the package aspect itself of the invention, the carton H with an attached cover L is shown in FIG. 2 with the dye ribbon spools removed to better show details of construction. Both carton and cover are formed from an elongated rectangular sheet of relatively stiff springy plastic, such as polyethylene terephthalate, which is thermo-formed, e.g. by vacuum forming, in the desired three-dimensional configuration. They are connected by a hinge constituted of a line of perforations 31 which can be torn apart to allow the cover to be separated if desired.

As formed, carton H has an elongated centrally extending concavity or depression 33 the bottom of which serves as the bottom of the carton. The depth of depression 33 could be equal on all sides but preferably, it slopes transversely of its length from a greater depth along its rear side adjacent cover L to a lesser depth adjacent its front side, as is visible at the left end of FIGS. 2 and 4. Depression 33 receives the supply spool $S_s$ and take-up spool $S_t$ in relatively closely spaced parallel relation (as can be seen in plan view in FIG. 3) and its front and rear walls 37 and 38 are rounded or curved to roughly match the curvature of the spools. Extending along the center of the depression 33 adjacent each end thereof is an upwardly projecting ledge 39 that separates the two spools and has curved sides similar to walls 37 and 38. To the front and rear of each ledge 39, depression 33 has shallow downwardly directed elongated ribs 41, only the front two of which can be seen in FIG. 1, which act as feet for the carton (see also FIG. 5) and prevent possible lateral rocking motion of the package during shipment etc that the flat rounded bottom of depression 33 might otherwise permit.

The margins of carton H on all sides of depression 33 project laterally as flat lips 43 that follow the sloping inclination of the top edges of depression 33 and impart greater strength to the carton and also function to protect the central region of the carton and the spools resting therein against sideways impact or pressure.

Referring particularly to FIGS. 1, 2 and 3, the opposite ends of the elongated central concavity or depression 33 in carton H are defined by upstanding walls constituting the inside faces of shoulders 45 and in each shoulder 45 are formed two transversely spaced apart upwardly opening U-shaped or substantially semi-cylindrical recesses 47 of a diameter appropriate for comfortably receiving the cylindrical collar journals of a spool. The U-shaped recesses in shoulders 45 at opposite ends of the central depression 33 are in axial alignment and maintain the spools therein in slightly transversely spaced apart parallel relation.

Intermediate the two U-shaped recesses in each shoulder 45 in order to impart guidance to the spools for placement in the respective recesses and insure positive separation between the spools within the package, the shoulder is extended generally vertically as a kind of pillar 49 having a flat upper surface. Given the greater height of back wall 38 of carton H than front wall 37 plus the presence of pillars 49 between the recesses, the rear recess has a greater depth than does the front recess. Otherwise, however, the upper surfaces of shoulders 45 in the regions between pillars 49 and end margins 43 at the carton ends extend horizontally as a kind of apron 48.

An important feature of the package of the invention is the creation of a positive engagement between the spools and the carton to prevent the spools from undergoing independent rotation about their respective axes while held within the carton. To this end, the outer faces of flanges 25 at one end of each spool have thereon, prior to the beginning of collar 27, an axially outwardly projecting boss 51 which is shaped as a regular polygon, e.g. a hexagon, best seen in FIG. 6, and the inner face of shoulder 45 proximate to each U-shaped recess 47 carries a corresponding polygonally, e.g. hexagonally, shaped socket 53 (see especially FIG. 5). When a spool is situated with its journal ends fitting within the U-shaped recesses 47, two or more of the flat sides of the polygonally shaped boss mate with two or more of the flat sides of socket 53 and thereby prevent rotation of a spool as long as the spool is seated within its U-shaped recess 47.

Although not necessary, the flanges 25 are both ends of the spools could if desired have the same polygonally shaped boss thereon with a matching socket in the shoulders at both ends of the carton. In that event, however, care would need to be taken to make certain that the polygonally shaped bosses at opposite ends of the same spool were in proper registration to insure simultaneous seating of the same in the corresponding sockets.

Figure 4:
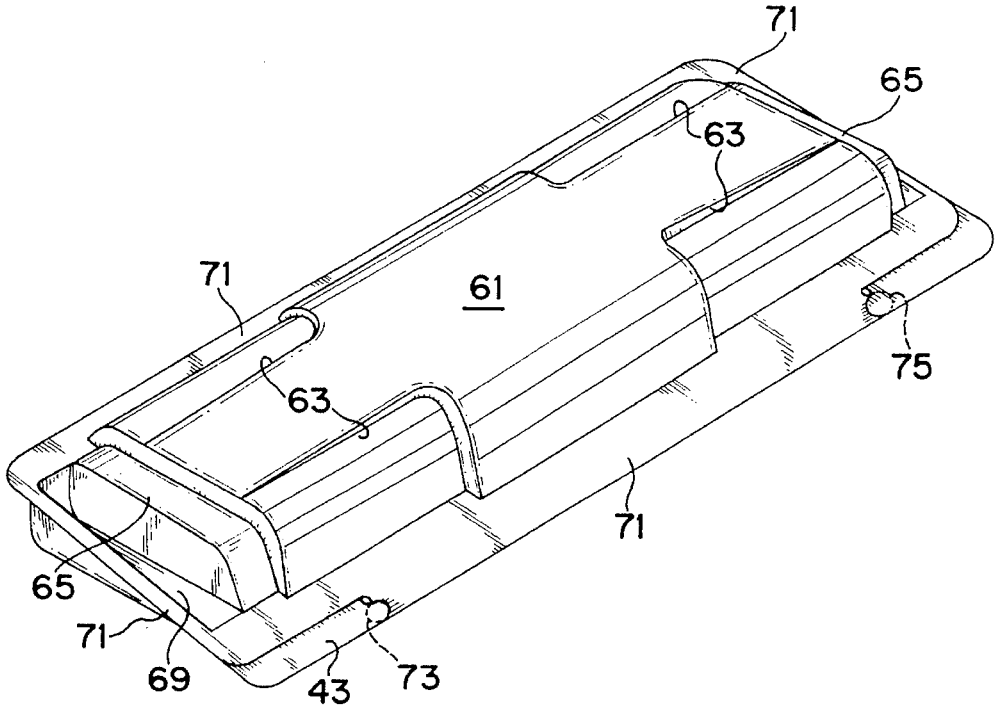
FIG. 4 is a perspective view of the package of the invention in closed condition.

The configuration of cover L can be seen from the inside in each of FIGS. 1 and 2 and from the outside in FIG. 4. There is an elongated flat central dome 61 in cover L that generally complements the central depression 33 of carton H to complete the enclosure of the supply and take-up spools in the package. Opposite front and rear corners of the dome can be formed as shallow recesses 63 which enhance the rigidity of the cover and also mate with the ribs 41 of a superposed carton when a plurality of the packages are stacked vertically. The flat surfaces of the generally central area of dome 61 are convenient locations for application of descriptive stickers, such as trademarks or other identifying information on the outside and on the inside pictograms explaining the loading sequence, which stickers have not been shown in the drawings. At the ends of dome 61 are stepped shoulders 65 in general axial alignment with the U-shaped recesses 47 to close the latter from above. At the end of cover L corresponding to the end of carton H which is provided with the polygonally shaped sockets 53 in shoulders 45, the stepped shoulder of the cover can carry similarly shaped shallow sockets 67 complementing the carton sockets 53 to apply when the cover is closed an additional anti-rotation action on the spools.

As appears in FIG. 4, the height of flat central dome 61 transversely of its length varies slopingly from a maximum at its front to a minimum at its rear in complementary fashion with the variation in the depth of the central depression 33 of the carton. The stepped shoulders 65 do not follow this slope but instead extend parallel to the (horizontal) plane of the flat dome 61. As a result, the outer walls ends of stepped shoulders 65 together with the adjacent margins of cover L define inclined tongues 69 (see the left ends of FIGS. 2 and 4) that project downwardly into the carton just outboard of the pillars 49 and aid in preventing any horizontal twisting of the carton and cover relative to one another.

Figure 5:
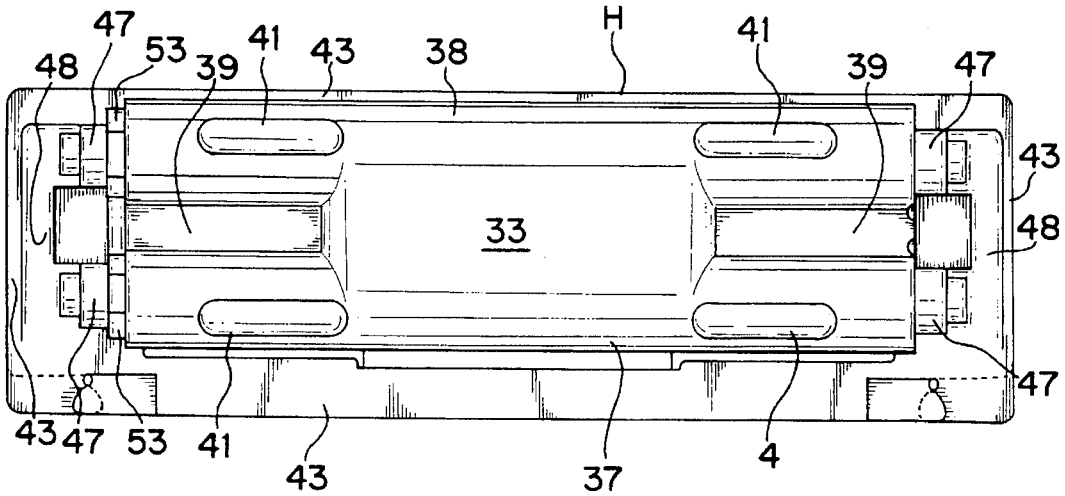
FIG. 5 is a bottom plan view of the package of the invention.

The outer margins of cover L form flat lips 71, similar to lips 43 on the carton, and when the cover is closed, the lips 71 come into direct face-to-face abutment with lips 43, as can be seen in FIG. 4. The abutting lips also provide a convenient way of locking the cover in closed position. To this end, the lips on the front sides of the carton and cover are cut away adjacent their ends to create cooperating tabs 73 and slots 75 which are adapted for interlocking engagement as shown in FIGS. 4 and 5. In the illustrated embodiment, the tabs 73 are on the cover and the slots 75 on the carton but this could obviously be reversed. Moreover, a different locking arrangement could be substituted if desired, e. g. one or more flat spring clips or the like clamping devices, not shown, adapted to clamp the respective marginal lips together at one or more points along the front sides thereof.

Alternative Embodiment

In the just described embodiment, the spools have the flanged collars 27 anchored on the supporting ends of spool core to prevent relative axial movement of the collars along the core end. As seen particularly in FIG. 3, a clearance exists between the end of the roll of dye ribbon on the supply spool and the adjacent inner face of the flange 25 to minimize the risk of side edges of the dye ribbon rubbing against the flange face as the dye ribbon is unwound from the spool. In an alternative embodiment illustrated in FIGS. 7–10 and given prime designations, the flanged collars are mounted on the core ends for limited relative axial sliding movement and the carton is provided with camming surfaces effective when the spools are introduced therein to displace the slidable flanged collars axially inwardly to a position proximate to the end faces of the roll of dye ribbon on supply spool $S_s$. In this manner, the so-displaced flanges prevent any axial sloughing or telescoping of the dye ribbon roll during transportation and handling. Then, when the spools are removed from the carton, the flanged collars can be shifted axially to a position separated from the dye ribbon roll ends to protect against chafing of the ribbon edges.

Figure 7:
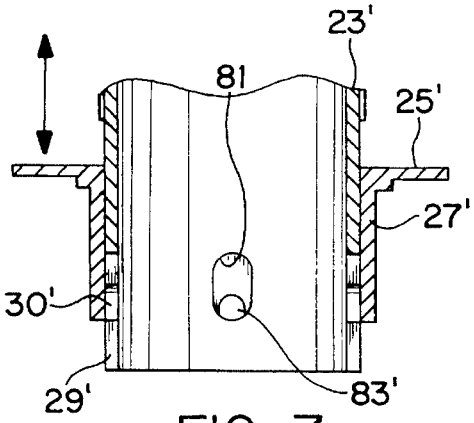
FIG. 7 is an enlarged detail view in section along its axis of an end portion of a dye ribbon spool of the invention showing an alternative mode of connection of an integral end flange and spool journal on an end of a ribbon supporting core which permits limited bodily axial movement on the core of the flange and journal while rotating with the core.
Figure 8:
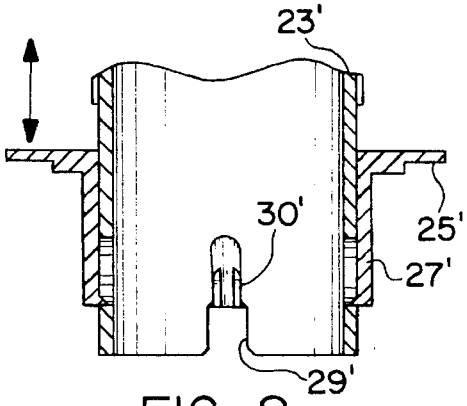
FIG. 8 is an enlarged detail view in section similar to FIG. 7 but with the section taken at a 90° angle to that of FIG. 7.

FIGS. 7 and 8 show the core ends in cross section at two orthogonal points therethrough, As before, flanges 25' are integral with collars 27' and are carried in telescoping relation on ends of cores 23'. Axial slots 29' are cut in the core ends at diametrically opposite points on the core periphery and the collars 29' have internally projecting lugs 30' at diametrically opposite points and which enter slots 29' when the collars are placed on the core end. The entrance end of slots 29' can be made wider than the inner termination which ultimately receives a lug 30' and the lugs can be radially bifurcated, both as shown in FIG. 8. The slots 29' and lugs 30' cooperate to cause the cores and collars to rotate bodily as a unit but do not in the form shown prevent relative axial movement therebetween. Up to this point, the structure of the alternative embodiment is the same as the initial embodiment.

Such relative rotation is prevented while yet permitting limited axial relative movement by the cooperating apertures 81 formed in the core ends at diametrically opposite points orthoganally removed from the slots 29' and small nibs 83 projecting internally of the collars 29'. The apertures 81 differ from the corresponding apertures of the initial embodiment in that they are axially elongated a distance comparable to the clearance of the flanges from the end faces of the ribbon supply roll. Thus, the flanged collars can be displaced axially toward and away from the roll faces a distance dependent on the axial length of the apertures, whereas the original apertures were simply rounded in a size suitable to receive similar small nibs.

To apply the axially displacing force to flanges 25', the carton is designed with downwardly and inwardly inclined camming surfaces for engaging the flanges when the spools are placed in the carton with their journals seated in the U-shaped recesses 47. One possible arrangement to accomplish this result appears in FIGS. 9 and 10 and will be given prime designations. FIG. 10 shows only the end portions of carton H' and only fragments of the central concavity or depression 33' appear together with the U-shaped recesses 47' into which fit the journals of the dye ribbon spool $S_r'$, the latter being shown only in phantom lines. Outside of recesses 47" are the aprons 48'. The inner surfaces of shoulders 45' instead of extending vertically as before are now inclined downwardly and inwardly and the same inclination extends to the inner face of pillars 49 Adjacent the lower ends of shoulder 45', the inner surfaces can be squared off vertically, as at 45*a*, to give a secure seat to the spool flanges in fully loaded position.

Figure 9:
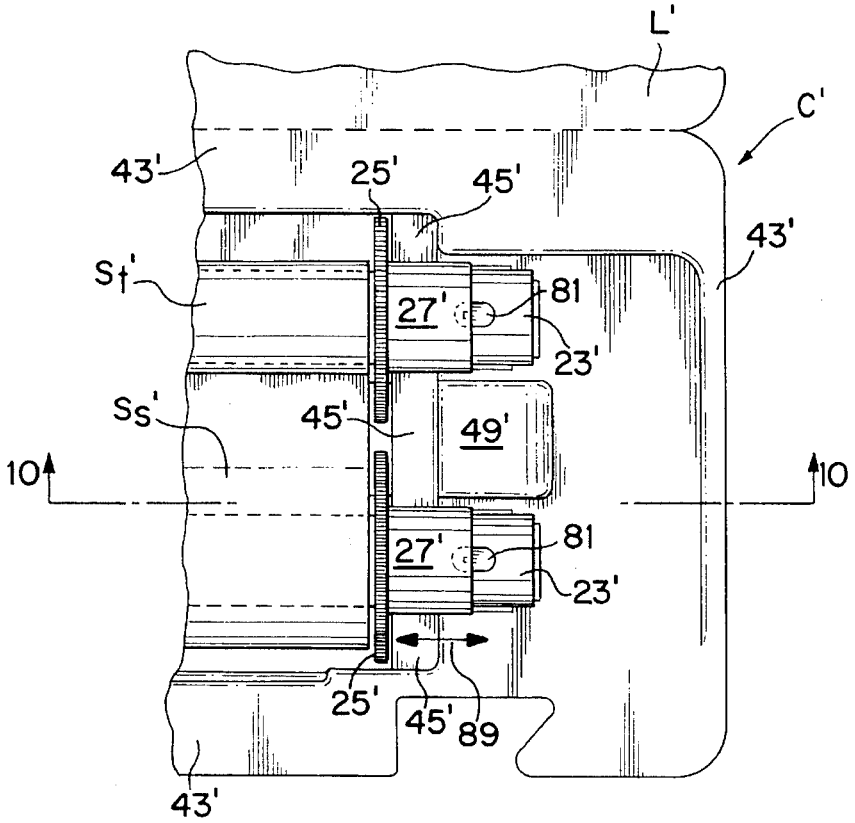
FIG. 9 is a fragmentary top plan view slightly enlarged of an end portion of an alternative embodiment of the package of the invention showing the structural features of the carton that cooperate with the modified form of spool of FIGS. 7 and 8.
Figure 10:
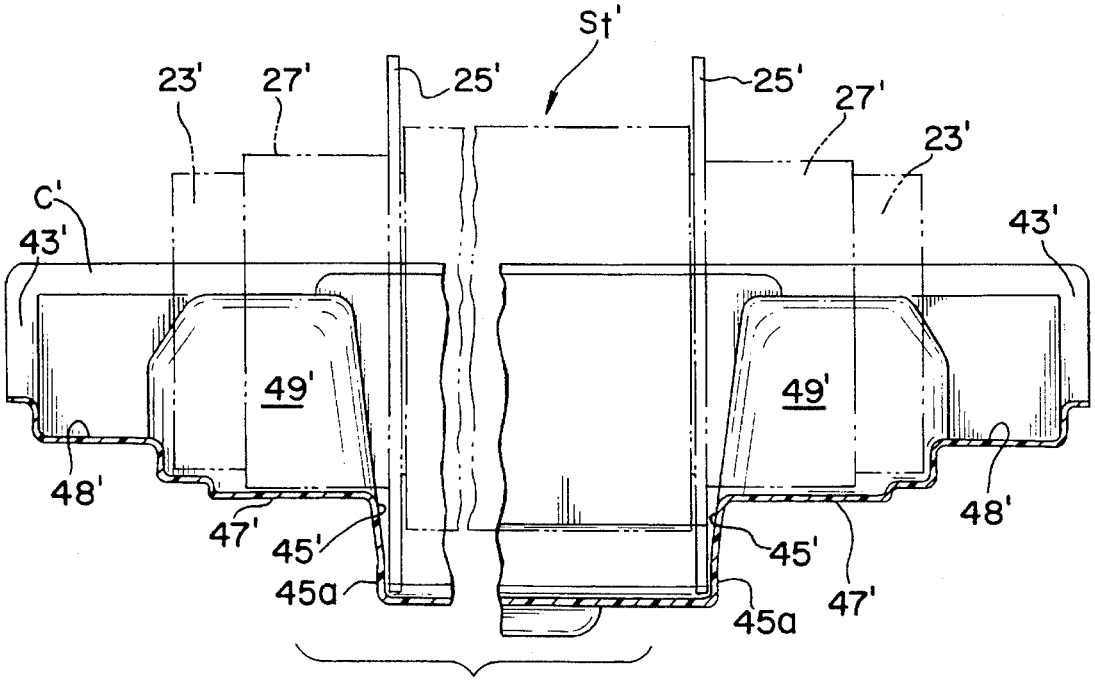
FIG. 10 is an enlarged view in longitudinal cross section taken substantially along line 10—10 of FIG. 9, with the center section of the carton broken away for conciseness, the cooperating end portions of the spools shown in phantom lines to reveal the relative position of the end flanges and journals of the spools when they are seated within the modified package.

An end portion of the alternative package embodiment appears in plan view in FIG. 9 in which the dye ribbon spools are shown in solid lines in their fully loaded position in carton H' and with the flanges 25' and collars 27' in fully inwardly displaced position. The axial displacement of the flanged collars is indicated by the arrow 89, the length of which is not intended to represent the actual extent of the displacement. When the spools are removed from the carton, the flanged collars are returned to their original position spaced a short distance from the end faces of the dye ribbon roll. As shown, the latter movement is carried out manually which is simple to achieve since when the core ends are grasped with the thumb and forefinger, the collars are contacted with the thumb and can readily be shifted outwardly. However, it would relative easy to equip the spools with some form of spring biasing means (not shown) acting to normally displace the flanged collars outwardly to the limit permitted by elongated slots 81. Thus, the spring biasing means would be depressed by the camming force of the inclined shoulder surfaces when the spools were loaded into the carton and when the camming force was released upon removal of the spools would urge the flanged collars outwardly clear of the dye ribbon edges.

In the course of the aforegoing description, certain variations and modifications have been suggested but others would readily apparent to one skilled in the art. Hence, the invention should not be construed as restricted to what has been expressly set forth except as might be required by the language of the appended claims.

That which is claimed is:

1. A method of transferring a supply spool having thereon a roll of dye ribbon which is wound in one direction and extends to a leading end that is affixed to a take-up spool and wound on said take-up spool in an opposite direction at least one turn therearound, said spools each having axially opposed journals at opposite ends thereof, from a storage package having an elongated base and generally upstanding abutments adjacent opposite ends of said elongated base, said abutments including two sets of axially spaced and aligned upwardly opening generally U-shaped slots for supporting the journals of said two spools in spaced parallel relation, to a reloadable cassette of a thermal printer which cassette is of generally flat open frame configuration and has two sets of laterally spaced apart axially aligned generally U-shaped bearings defining two spool positions which are spaced apart in a direction transverse to the bearing axes with their axes parallel to each other and to the flat direction of the cassette, the spacing separating the two spool positions in said cassette being substantially greater than the spacing between the axes of said two sets of U-shaped slots in said package, wherein said spools are arranged in said U-shaped slots of said package with a length of said dye ribbon extending between the outermost windings on said supply and take-up spools at an inclined angle from an upper side of said supply roll directed generally away from said base of said package to an underside of said take-up spool, which comprises the steps of placing the reloadable cassette on a flat surface, locating said dye ribbon package on said surface adjacent said cassette with the axes of said slots in said package in generally parallel relation to the axes of said bearings in said cassette, said abutments of said package in general transverse alignment with said bearings in said cassette and said supply spool proximate to said cassette, removing from the package said take-up spool and transferring the same to the spool position in said cassette nearest to said package to engage its journals in the bearings at said spool position, whereby a portion of the outermost turn of dye ribbon wound on said take-up spool is unwrapped therefrom as an inherent result of the take-up spool transfer, and then removing from said package said supply spool and transferring the same to the spool position of said cassette which is remote from said package to engage the journals thereof in the bearings at said position, whereby a portion of the outer winding of ribbon on said supply roll is unwrapped therefrom as an inherent result of the supply roll transfer and the combined length of the portions of dye ribbon thus unwrapped is at least equal to the difference between the separation of the spool positions in said cassette and the separation between the two sets of slots in said package.

2. The method of claim 1 wherein said take-up and supply spools are transferred from said package to said cassette substantially without rotation thereof about their respective axes.

3. The method of claim 1 including a final step of after transfer of said take-up and supply spools to said cassette, rotating at least one of said spools within its respective bearings as necessary to remove any slack in the length of dye ribbon stretching between said spools.

4. A dye ribbon package for use with a thermal printer and containing a supply spool and a take-up spool, said supply spool carrying a roll of dye ribbon wound thereon with a leading end extending from such roll and anchored to said take-up spool for rewinding the ribbon on said take-up spool as it is unwound from the supply spool, each of said spools having a winding core, cylindrical journals at opposite ends of said core for supporting said spools, and circular flanges one adjacent each end of the core inboard of said cylindrical journal and rotating with said core, the circular flange at one end of each core having a polygonal shaped boss which is integral with an outer face thereof and projects axially outwardly therefrom to terminate inboard of said journal, said package comprising an elongated bottom wall having a length dimension exceeding the length of said cores, and abutments integral with said bottom wall and projecting generally vertically thereto adjacent opposite ends of said bottom wall, said abutments being spaced apart a distance substantially equal to the distance between the outer faces of two opposite flanges and being each formed with two upwardly opening generally U-shaped slotlike recesses spaced apart transversely of the length of said bottom wall, said slotlike recesses being arranged in pairs, one in the abutment at each at the opposite ends of said bottom wall, in axially aligned relationship to receive the journals of one of said spools and support the same in parallel relationship to the other spool, said slotlike recesses permitting removal therefrom of the spools in a direction generally normal to said bottom wall of said package, one of each pair of said slotlike recesses being shaped on a side thereof toward a flange of the spool supported by said pair with a semi-polygonal socket mating with a portion of a polygonal shaped boss on said flange to prevent rotation of a spool about its axis while the journals thereof are within said slotlike recesses.

5. The dye ribbon package of claim 4 wherein said cores have free ends accessible axially for gripping by an operator's fingers while the core journals are received within said slotlike recesses.

6. The dye ribbon package of claim 4 wherein said bottom wall has a generally centrally located elongated depression therein of w width sufficient to accommodate both of said spools when the journals thereof are within said slotlike recesses and said abutments comprise end walls of said depression.

7. The dye ribbon package of claim 6, wherein said depression has side walls parallel to the length of said bottom wall which are curved arcuately in a direction transverse to said length in general conformity to the cylindrical curvature of said flanges.

8. The dye ribbon package of claim 6 wherein said bottom wall has substantially flat stiff margins projecting laterally on all sides of said depression for purposes of lateral protection of said dye ribbon spools contained therein.

9. The dye ribbon package of claim 4 wherein each of said circular flanges forms an integral unit with one of said cylindrical journals and one of said integral units is mounted in collar fashion on each of the opposite ends of a separate tubular core for bodily rotation with said core.

10. The dye ribbon package of claim 9 wherein one of said integral units is engaged on each of the opposite ends of a core for limited axial sliding movement relative to the core while rotating bodily therewith.

11. The dye ribbon package of claim 9 wherein said spools are adapted to be transferred from said package to certain spool positions provided in a cassette associated with said thermal printer, said integral flange and journal units at at least one end of said cores are distinctly colored and said spool positions in said cassette are correspondingly colored to facilitate the transfer of said spools to the appropriate spool position in said cassette.

12. The dye package of claim 4 wherein said abutments have inner faces inclined slightly upwardly and axially outward, the inclined faces engaging when the journals of a spool are received in said slotlike recesses end faces of said flanges to displace said flanges axially inwardly to bring said flanges into close proximity with ends of the roll of dye ribbon carried on said core.

13. The dye ribbon package of claim 4 wherein said bottom wall forms a package base and said package further comprises a cover for said base hingedly connected to said bottom wall along an edge thereof parallel to its length and said supply spool is located in said package with the journals thereof remote from said edge connected to said cover.

14. The dye ribbon package of claim 13 wherein said cover and base are hingedly connected by a perforated hinge whereby the cover may be separated from said base by rupturing the perforations of said hinge.

15. The dye ribbon package of claim 13 wherein said cover includes a generally centrally located elongated dome adapted to fit over said two spools when contained within the base and generally stiff flat margins projecting laterally from all sides of said dome to fit in close superposed relation to the flat margins of the bottom wall when said cover is in closed position and further comprising means for securing said margins of said base and cover together at at least one point therearound to hold the cover in closed position.

16. The dye ribbon package of claim 15 wherein said margins of said cover and bottom wall have cooperating tabs and slots therein that are interlockable to hold the cover in closed position on said base.

17. A dye ribbon package for use with a thermal printer and containing a supply spool and a take-up spool, said supply spool carrying a roll of dye ribbon wound thereon with a leading end extending from such roll and anchored to said take-up spool for rewinding the ribbon on said take-up spool as it is unwound from the supply spool, each of said spools having a winding core, cylindrical journals at opposite ends of said core for supporting said spools, and circular flanges one adjacent each end of the core inboard of said cylindrical journals and rotating with said core, and said flanges are engaged on opposite ends of each core for limited axial sliding movement relative to the core while rotating bodily therewith, said package comprising an elongated bottom wall having a length dimension exceeding the length of said cores, and abutments integral with said bottom wall and projecting generally vertically thereto adjacent opposite ends of said bottom wall, said abutments being spaced apart a distance substantially equal to the distance between the outer faces of said flanges at opposite ends of said cores and being each formed with two upwardly opening generally U-shaped slotlike recesses spaced apart transversely of the length of said bottom wall, each of said slotlike recesses being axially aligned with a corresponding slotlike recess in the abutment at the opposite end of said bottom wall to receive the journals of a spool and support the same in transversely spaced parallel relationship, said slotlike recesses permitting removal therefrom of the spools in a direction generally normal to said bottom wall, said abutments having camming surfaces thereon operative to displace said flanges inwardly into proximity to the end faces of the rolls of ribbon wound on said spools when said spools are placed within said package with the journals thereof seated in said U-shaped slotlike recesses in said abutments.

18. The dye ribbon package of claim 17 wherein said cores have free ends accessible axially for gripping by an operator's fingers while the core journals are seated within said slotlike recesses.

* * * * *